United States Patent [19]

Wilson

[11] Patent Number: 4,585,233

[45] Date of Patent: Apr. 29, 1986

[54] BOARD GAME STRUCTURE

[76] Inventor: Peter Wilson, Ferry Rd., Hadlyme, Conn. 06439

[21] Appl. No.: 614,069

[22] Filed: May 25, 1984

[51] Int. Cl.[4] ..... A63F 3/00; A63F 9/00

[52] U.S. Cl. ..... 273/256; 273/287; 273/283

[58] Field of Search ..... 273/276, 283, 284, 309, 273/287

[56] References Cited

U.S. PATENT DOCUMENTS 715,794 12/1902 Haskell ..... 273/284

3,588,113 6/1971 Nelson ..... 273/284

FOREIGN PATENT DOCUMENTS 2055299 3/1981 United Kingdom ..... 273/287

*Primary Examiner*—Richard C. Pinkham

*Assistant Examiner*—Benjamin Layno

*Attorney, Agent, or Firm*—Fishman & Dionne

[57] ABSTRACT

A board game which is capable of being used in conjunction with a known standard or conventional board game and will thereby provide expanded and more complex game play is presented. The present invention is particularly well suited for those conventional board games having adjacent spaces along the perimeter thereof. In a preferred embodiment, the game board has a recessed interior portion capable of receiving the standard board. Preferably, the inner conventional board game is a well known MONOPOLY game while the surrounding game board of the present invention contains a plurality of spaces having subject matter compatible with the subject matter of the MONOPOLY spaces. At least one space on the outer board game will access the standard board for entry and exit therefrom.

8 Claims, 3 Drawing Figures

BOARD GAME STRUCTURE

BACKGROUND OF THE INVENTION

This invention relates to the field of games for amusement and entertainment. More particularly, this invention relates to a new and improved board game which is capable of being used in conjunction with well known or conventional board games thereby providing expanded and more complicated game play. Accordingly, greater skills and player satisfaction may be achieved from any number of well known prior art games.

Board games have been extremely popular for many years with both young and old participants. While certain prior art board games have waned in popularity, other well known games have retained wide notoriety and acceptance and, in some cases, the particular game has increased its following by the game playing public.

For example, the well known and established game of MONOPOLY manufacutred by Parker Brothers, Inc. has maintained a steady following of avid expert and beginner players. MONOPOLY is described in U.S. Pat. No. 2,026,082 which is incorporated herein by reference thereto. It will be appreciated that any reference herein to the term MONOPOLY refers to the game board and rules substantially as described in U.S. Pat. No. 2,026,082. Similarly, other famous board games have a continuing and at times growing group of player-fans.

Unfortunately, it has become apparent that many players of conventional board games begin to tire from the identical game play over a plurality of playing times. The resulting boredom may often act to stifle competition, continuing development of skills and overall interest in the particular board game.

It would be advantageous therefore, to provide a means whereby the game play and level of difficulty of popular prior art board games could be expanded, thereby increasing competition, skills and interest.

SUMMARY OF THE INVENTION

The above discussed and other deficiencies of the prior art are overcome and alleviated by the novel board game of the present invention. In accordance with the present invention, a novel board game capable of being used in conjunction with conventional prior art game boards is provided.

The game board is especially well suited for those board games of the type having adjacent spaces along the perimeter thereof. The novel board game of the present invention preferably has a stepped-down cavity region in the interior thereof which can receive a particular well known game board. This allows the perimeter of the novel outer game board to be planar with the upper surface of the inner standard or conventional game board. The result is expanded and more complicated game play along with greater player satisfaction. Of course, it will be understood that the particular configuration of the novel, outer game board surface will be in the same or similar mode, and contain similar subject matter as the standard board placed therein, so as to maintain a sense of continuity and compatibility of game play between the two boards.

In a preferred embodiment, the conventional board game utilized in conjunction with the novel outer board is the well known MONOPOLY game. Accordingly, access means are provided whereby a player may move his playing piece from the internal conventional MONOPOLY board to spaces having similar subject matter on the perimeter of the external novel game board. The surrounding outer game board will, of course, include additional real estate, utilities and other such playing spaces.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
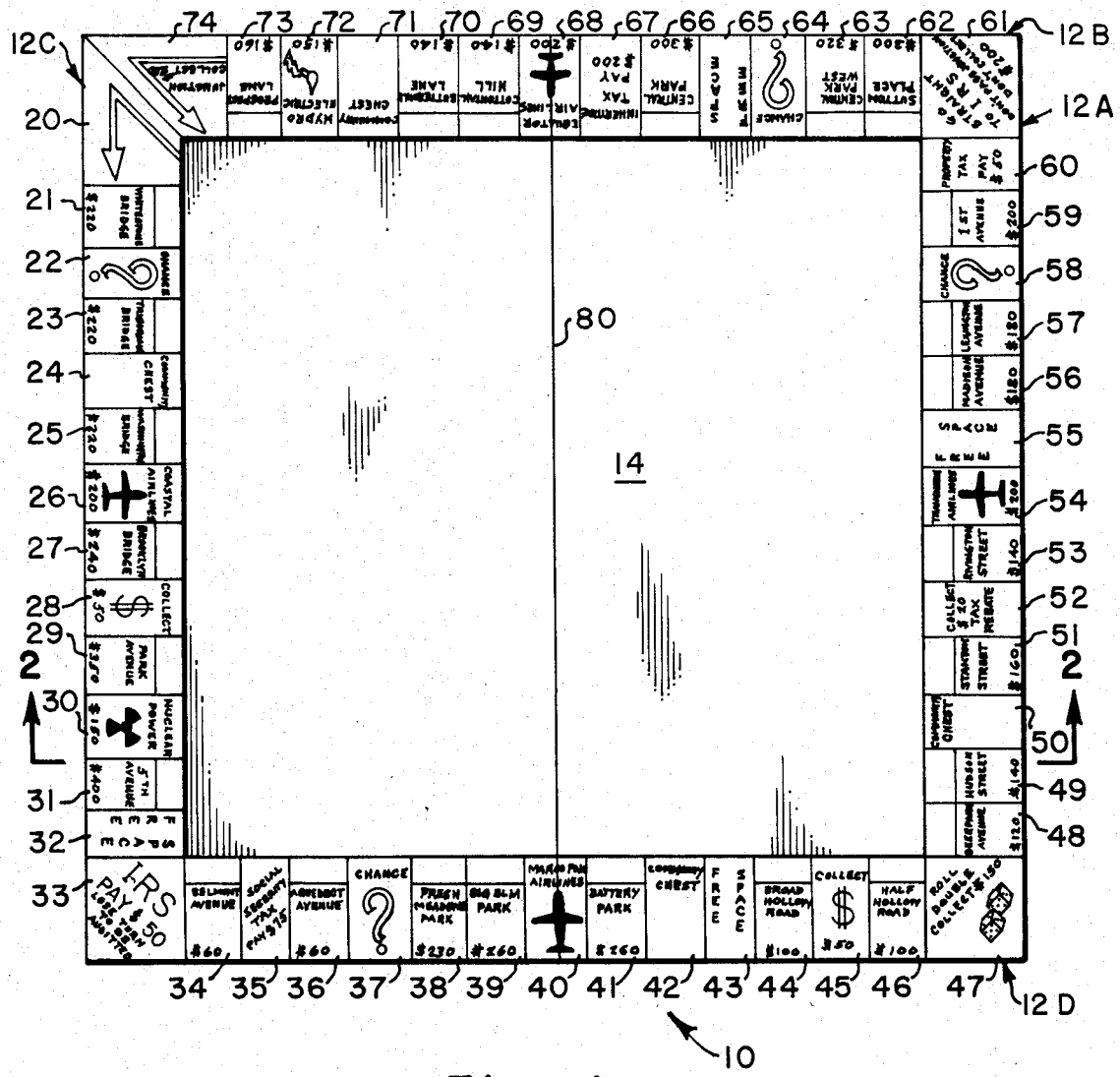
FIG. 1 is a plan view of a preferred embodiment of a game board in accordance with the present invention.
Figure 2:
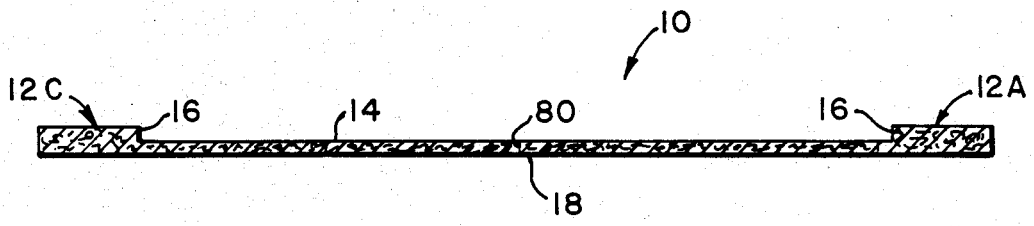
FIG. 2 is a cross-sectional elevation view of the board of FIG. 1 along the line 2—2.

Referring first to FIGS. 1 and 2, a game board in accordance with the present is shown at 10. The board 10 comprises a raised perimeter consisting of four edge portions 12A–12D and a recessed interior 14 surrounded by a step or shoulder 16. The interior 14 should have an area about equal to that of the conventional game board which is to be inserted therein. Similarly, the shoulder 16 should preferably have a height about equal to the thickness of the inserted game board so that the top surface of the edge portions 12A–12D are planar with the top surface of the inserted game board. As shown in FIG. 2, the bottom surface 18 of board 10 is preferably flat so as to securely sit on a table top or the like.

Each edge portion 12A–12D is preferably subdivided into a plurality of spaces for moving a playing piece or marker. It should be understood that the particular configuration of each space will depend upon the conventional or other board game which is to be inserted within the interior recess 14. The game board of the present invention is aptly suited for those conventional board games wherein there is a plurality of playing spaces around the peripheral portion of the board. Accordingly, the subject matter of the spaces in board 10 should be selected so as to be of the same or similar genre as the inserted board game in order to maintain a degree of continuity and compatibility between the two cooperating boards.

Figure 3:
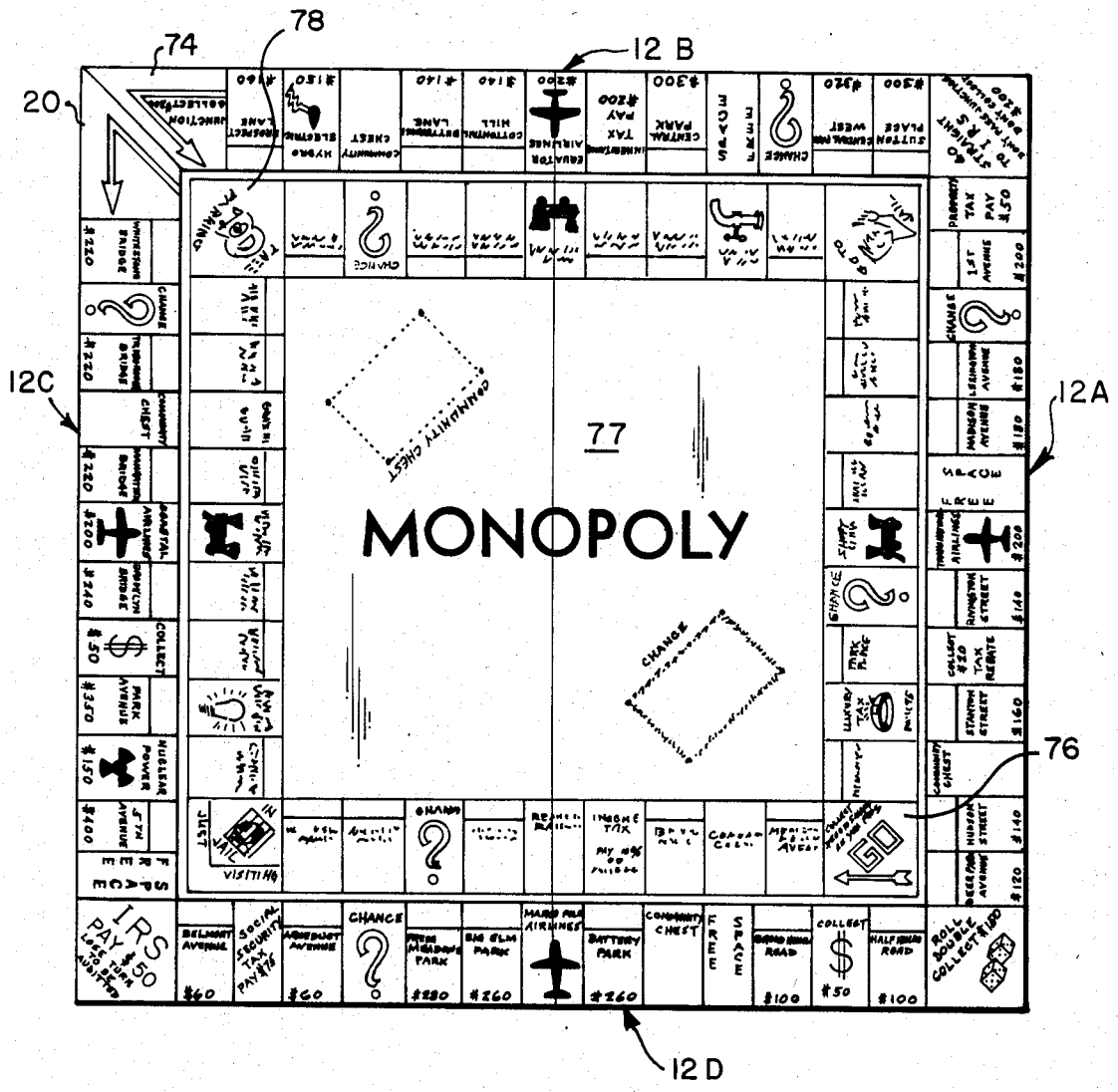
FIG. 3 is a plan view, similar to FIG. 1, but having a conventional game board inserted therein.

In a preferred embodiment of the present invention shown in FIGS. 1 and 3, one well known prior art board game which is well suited for use in conjunction with the present invention is the game of MONOPOLY manufactured by Parker Brothers, Inc. For a detailed description of MONOPOLY rules, reference is made to the now expired U.S. Pat. No. 2,026,082 which has been incorporated herein by reference. In this embodiment of the present invention, the game board 10 has provided a plural number of spaces which act to greatly expand the game play and, as a result, the compelxity of conventional MONOPOLY. The spaces identified at 20–74 include groups of real estate areas or spaces, airline spaces, free spaces, utilities, chance, community chest and corner spaces.

It will be understood that while particular spaces have been identified in detail in FIGS. 1 and 3, other spaces having similar subject matter are included by the game board of the present invention so long as the selected subject matter within the spaces is compatible with a standard MONOPOLY game.

Referring now to FIGS. 1 and 3 in more detail, there are actually nine groups of real estate including spaces 21, 23, 25 and 27 forming a first group (Bridges) and the other groups being formed of 29 and 31; 34 and 36; 38, 39 and 41; 44, 46 and 48; 49, 51 and 53; 56, 57 and 59; 62, 63 and 66; and 69, 70 and 73, respectively. Four airline companies are identified at 26, 40, 54 and 68 while various taxes, power companies, free spaces, chance, community chest and other miscellaneous spaces make up the remainder of the board 10.

An important feature of the game board 10 are spaces 20 and 74 whereby the inner and outer game boards may be accessed. Thus, with reference to FIG. 3, a player would begin the improved, expanded game of the present invention at the "GO" space 76 and proceed around the inner perimeter of the conventional MONOPOLY game board 77 until the "Free Parking" space 78 whereupon the player would then access the outer game board 10 at space 20. Subsequently, having moved through all the spaces 20–73, the player would move to space 74 and then reenter the original MONOPOLY game board 77 at "Free Parking" 78, finally continuing around the interior board 77 back to the beginning "GO" space 76.

Thus, in essence, the game play of conventional MONOPOLY is expanded by at least 100% thereby creating more excitement and more complicated and complex play.

It should be understood that while the FIGURES have shown the interior prior art game board being received by a stepped-down recess 14, any other receiving means could equally suffice in securing the two boards together. For example, spaced tab extensions on the outer game board could grasp and hold the inner standard board. In fact, the receiving means may simply consist of a proper boundary line drawn on the novel game board so as to prevent the standard board from overlapping peripheral spaces on the outer board.

A longitudinal partial cut 80 as shown in FIG. 1 may be made along the middle of board 10 so that the board may be folded over thereby providing a more compact board for storage and transportation.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A game board comprising;

first board means having plural edge portions along the perimeter therof;

a plurality of substantially planar first spaces disposed along each of said edge portions, said plurality of first spaces terminating along said first board means perimeter, each of said first spaces being provided with selective indicia and said indicia denoting at least one access space for entry into and out of said first board means;

a second game board, said second game board having plural second spaces, said second spaces having similar selective indicia relative to said indicia of said first spaces; and means for receiving said second game board;

said receiving means aligning said second game board with said first board means whereby said first spaces are concentric to said second spaces and whereby said access space on said first board means permits entry into and out of said second game board.

2. The game board of claim 1 wherein:

said receiving means comprises a recessed interior portion surrounded by a shoulder, said recess capable of accepting said second game board after insertion therein.

3. The game board of claim 2 wherein:

said recessed interior has an area about equal to the area of said second game board.

4. The game board of claim 2 wherein:

said shoulder has a height about equal to the thickness of said second game board whereby said second spaces of said second game board are about planar with said first spaces of said first game board means.

5. The game board of claim 1 wherein:

said plural second spaces of said second game board are along the periphery thereof.

6. The game board of claim 1 wherein:

said second game board is a game board substantially similar to the game board described in FIG. 1 of the U.S. Pat. No. 2,026,082.

7. The game board of claim 6 wherein:

said selective indicia of said first game board means is compatible with the indicia of said game board described in FIG. 1 of the U.S. Pat. No. 2,026,082.

8. A game board comprising:

first board means having plural edge portions along the perimeter thereof;

a plurality of first spaces disposed along each of said edge portions, said plurality of first spaces terminating along said first board means perimeter, each of said first spaces provided with selective indicia and said indicia denoting at least one access space for entry into and out of said first board means;

a second game board, said second game board having plural second spaces, said second spaces having similar selective indicia relative to said indicia of said first spaces; and means for receiving said second game board;

said receiving means aligning said second game board with said first board means whereby said first spaces are concentric to said second spaces and whereby said access space on said first board means permits entry into and out of said second game board;

said receiving means comprising a recessed interior portion surrounded by a shoulder, said recess adapted for accepting said second game board after insertion therein;

said shoulder having a height about equal to the thickness of said second game board whereby said second spaces of said second game board are about planar with said first spaces of said first game board means.

* * * * *